US005713525A

United States Patent [19]

Morey

[11] Patent Number: 5,713,525

[45] Date of Patent: Feb. 3, 1998

[54] HORIZONTAL COMMINUTING MACHINE PARTICULARLY FOR RECYCLABLE HEAVY WOOD RANDOMLY CARRYING NON-SHATTERABLE FOREIGN PIECES

[75] Inventor: Norval K. Morey, Weidman, Mich.

[73] Assignee: Wood Technology, Inc., Winn, Mich.

[21] Appl. No.: 414,434

[22] Filed: Mar. 31, 1995

[51] Int. Cl.[6] ..... B02C 18/16

[52] U.S. Cl. ..... 241/32; 241/88.4; 241/222; 241/290; 241/300

[58] Field of Search ..... 241/222, 224, 241/225, 32, 290, 286, 294, 300, 197, 88.4, 242, 243

[56] References Cited

U.S. PATENT DOCUMENTS

| | | | |
|---|---|---|---|
| 325,849 | 9/1885 | McKendrick . | |
| 649,985 | 5/1900 | Hall . | |
| 1,675,658 | 7/1928 | Mursch . | |
| 2,133,212 | 10/1938 | Schutte et al. . | |
| 2,196,722 | 4/1940 | Clement . | |
| 2,208,892 | 7/1940 | Bukacek . | |
| 2,488,799 | 11/1949 | Bonnafoux . | |
| 2,530,313 | 11/1950 | Parten . | |
| 2,825,371 | 3/1958 | Forman | 241/254 X |
| 2,899,992 | 8/1959 | Key . | |
| 3,214,106 | 10/1965 | Gorman | 241/294 X |
| 3,612,420 | 10/1971 | Hull . | |
| 3,838,823 | 10/1974 | Lewis | 241/32 |
| 3,847,358 | 11/1974 | Lowe et al. | 241/32 |
| 3,856,217 | 12/1974 | Brewer . | |
| 3,856,218 | 12/1974 | Harmon et al. . | |
| 3,857,520 | 12/1974 | Ducasse . | |
| 3,876,159 | 4/1975 | Kidd | 241/32 |
| 3,891,152 | 6/1975 | Guggenheimer | 241/88.4 |
| 3,981,455 | 9/1976 | Kaczmarek . | |
| 3,995,783 | 12/1976 | Bertrand et al. . | |
| 4,083,502 | 4/1978 | Dittman . | |
| 4,120,459 | 10/1978 | Lowe et al. . | |
| 4,147,193 | 4/1979 | Kivimaa . | |
| 4,164,329 | 8/1979 | Higby . | |
| 4,257,511 | 3/1981 | Miller . | |
| 4,358,995 | 11/1982 | Ballo et al. . | |
| 4,454,995 | 6/1984 | Bloomquist | 241/294 X |
| 4,504,019 | 3/1985 | Newell et al. . | |
| 4,597,538 | 7/1986 | Getz | 241/88.4 X |
| 4,678,126 | 7/1987 | Prentice et al. . | |
| 4,687,144 | 8/1987 | Irwin et al. . | |
| 4,697,626 | 10/1987 | Arasmith . | |
| 4,756,068 | 7/1988 | McClure et al. . | |
| 4,771,953 | 9/1988 | Morey . | |
| 4,795,103 | 1/1989 | Lech . | |
| 4,997,135 | 3/1991 | Zehr . | |
| 5,060,875 | 10/1991 | McBride | 241/294 X |
| 5,155,975 | 10/1992 | Knowler . | |

*Primary Examiner*—Mark Rosenbaum
*Attorney, Agent, or Firm*—Learman & McCulloch

[57] ABSTRACT

A horizontal comminuting machine for reducing recyclable waste wood and other comminutable material which may have non-reducible foreign objects incorporated with it has a generally horizontal rotary drum mounting a plurality of peripherally spaced communinuting tools traveling in a continuous work contacting path. A feed works delivers material forwardly to the rotating drum in a longitudinal feed stream and to a lead anvil which, under undue operating pressure, withdraws from an operative position adjacent the path of the tools to a removed position. An anvil confining assembly on the machine frame controls the travel of the anvil. Rearwardly of the lead anvil, individual anvils are mounted to cooperate with the tools to further reduce the material.

17 Claims, 9 Drawing Sheets

23b
57
23a
24
41
50
54
56b
23c
56
56a
29
48
52
53
51
49
46
26
28b
27a
28c
27
28
28b
71
25a
72
70
70a
73
69
69b
69a
68
68a
22a
62a
72
67
67a
71
46
73
62d
60
61a
40
61
62c
63
62b
41
42
17a
10
20
19
F
C
18
23
23a
28
31
33a
30
33

57
23a
56
23b
24
22a
102
101
100
27
25
26
28b
85a
85c
96
94
56b
56
56a
56
85
85b
85d
87
98
97
29
17a
10a
18
19
30
33
31
28
23
23a

HORIZONTAL COMMINUTING MACHINE PARTICULARLY FOR RECYCLABLE HEAVY WOOD RANDOMLY CARRYING NON-SHATTERABLE FOREIGN PIECES

This invention relates to machines known commercially as hogs and, particularly, to machines that may be very effectively used to comminute wood material such as the heavy structural timbers which remain from the demolition of old buildings and the like, as well as old railroad ties and the heavy pallets which are widely used in industry, for example. Such debris, which is expensive to landfill in its non-comminuted state, and from an environmental standpoint should not be simply buried in that state because it occupies too much volume, frequently carries metal fittings, plates and the like which are capable of damaging the comminuting machines.

BACKGROUND OF THE INVENTION

Today, material of the character mentioned is comminuted in tub grinders of the character described in my co-pending application Ser. No. 048,792 filed Apr. 14, 1993, now U.S. Pat. No. 5,419,502 and entitled TUB GRINDER SYSTEMS AND METHODS FOR COMMINUTING WASTE WOOD, and which is incorporated herein by reference. Such tub grinders are also subject to damage when metal plates, pieces of pipe and masonry, and other foreign objects are encountered during the comminuting operation, and can experience significant damage and downtime as a result. To operate them efficiently, the debris needs to be culled in the first place to eliminate the non-comminutable pieces which create the problems. The so-called horizontal tub grinders further are limited in the length of material which can be accommodated and do not have as positive a feed system as the new machine which will presently be described in detail. Out of expediency, the first answer to recycling material of the heavy character described was to modify the existing tub grinder, rather than create a new machine to perform the task. In terms of mechanical principle of operation, the new machine to be hereinafter described is conceptually designed for the task which it is to accomplish, whereas the currently used, modified tub grinders were designed to grind agricultural materials.

SUMMARY OF THE INVENTION

The present invention is concerned with a horizontal hog which incorporates a rotary drum having a plurality of peripherally spaced, axially extending comminuting members, a feedworks for positively delivering the material to be comminuted forwardly to the rotary comminuting drum in a longitudinally moving material feed stream, and a multiple anvil system including an initially encountered breakaway anvil bar mounted for withdrawing travel from an operative position adjacent the rotary path of the comminuting members to a removed position. The lead anvil may be mounted by shear bolts which are severed when a predetermined pressure is applied, or may be normally maintained in operative position by a yieldable force exerter under a preload pressure greater than that imposed by wood material that can be comminuted in the machine. Metal plate material and the like, which is effectively separated from the wood material at the time of initial impact and causes the anvil to breakaway, is thrown out by centrifugal force while the wood fragments tend to be carried on through the machine.

One of the prime objects of the present invention is to provide a machine which is expressly designed to handle heavy waste wood material of the character described and, while handling the material more effectively, can be sold at a considerably reduced price.

Another important object of the invention is to provide a far safer operating machine which confines the material and prevents it from being thrown out and injuring people in the area.

A further object of the invention is to provide machines which avoid damage to the drums and drum shafts, and the shaft bearings, while still providing follow-on chipping with easily changeable, individually replaceable anvils which assure a finer comminution of the wood material.

Still another object of the invention is to provide a machine having an anvil system in which individual anvils extend to span and extend through the side frames of the machine and mount externally on the sides of the machine to facilitate replacement of the anvils and their individual adjustment rotation to positions which provide fresh edges when their edges become chipped or worn.

A further important object of the invention is to provide a feed wheel system wherein the feed wheel is carried by a yoke which is uniquely mounted to be pivotal on the axis of the drum without creating a load on the drum shaft, to avoid creating space between the drum and feed wheel into which material can be carried by the feed wheel without feeding into the drum.

Still a further object of the invention is to provide a machine of the type described which, in one embodiment, provides an initial anvil-biasing preload spring situated internally to virtually span the length of the retractable anvil and exert a sufficient anvil preloading force to make sure that the heavy wood is reduced, with the preload being variable to accommodate to the material being reduced.

Still another object of the invention is to provide a rugged machine of a durable nature which can be economically operated at chosen locations, for example, in the field at the site of a demolition, or at a landfill.

Another object of the invention is to provide a machine of the type described in which a large proportion of the heavier metal pieces and foreign objects are removed at the location of the lead anvil while the wood fragments are carried to downstream anvils which will further reduce them, even though the lead anvil is in a retracted position.

Other objects and advantages of the invention will become apparent with reference to the accompanying drawings and the accompanying descriptive matter.

THE DRAWINGS

The presently preferred embodiments of the invention are disclosed in the following description and in the accompanying drawings, wherein.

DETAILED DESCRIPTION

Figure 1:
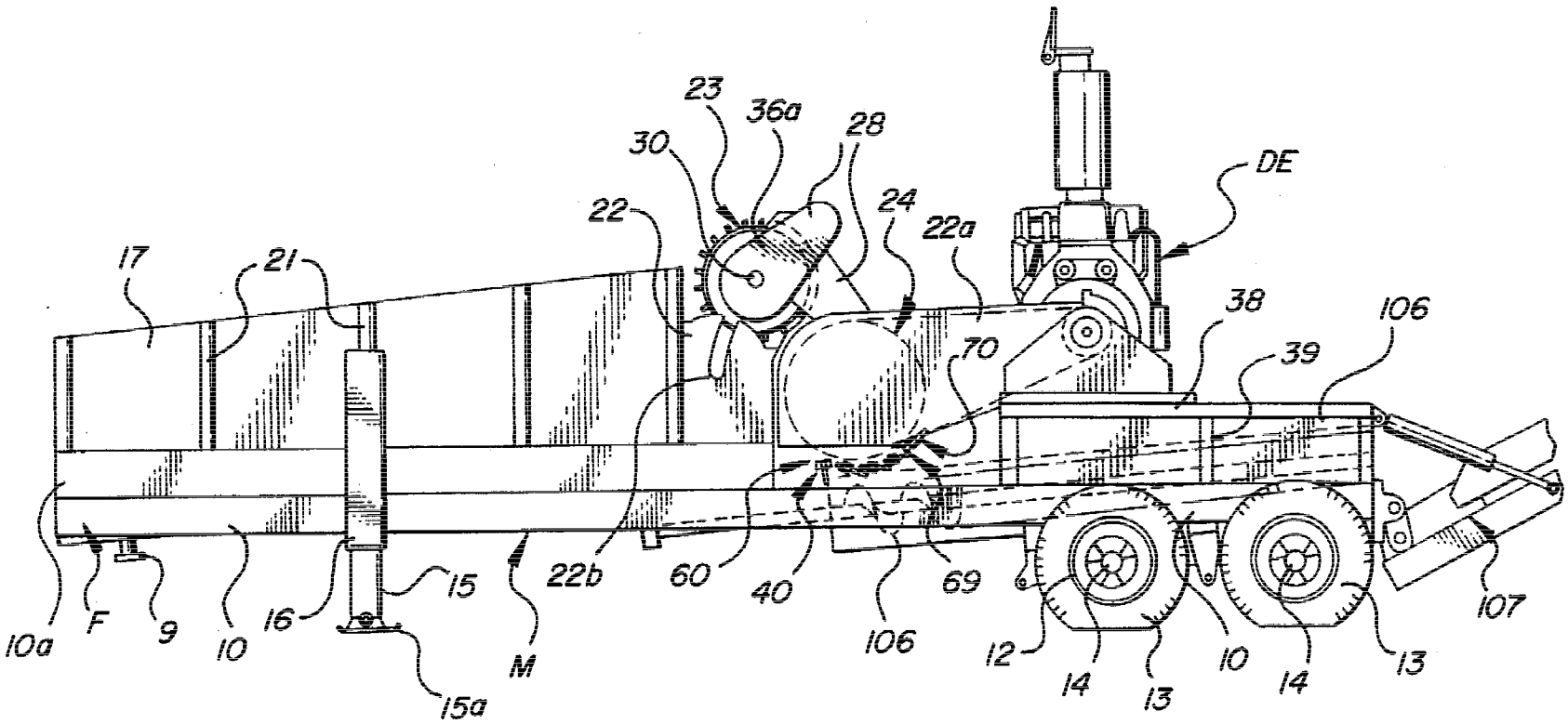
FIG. 1 is a schematic side elevational view of the machine.
Figures 2, 3A:
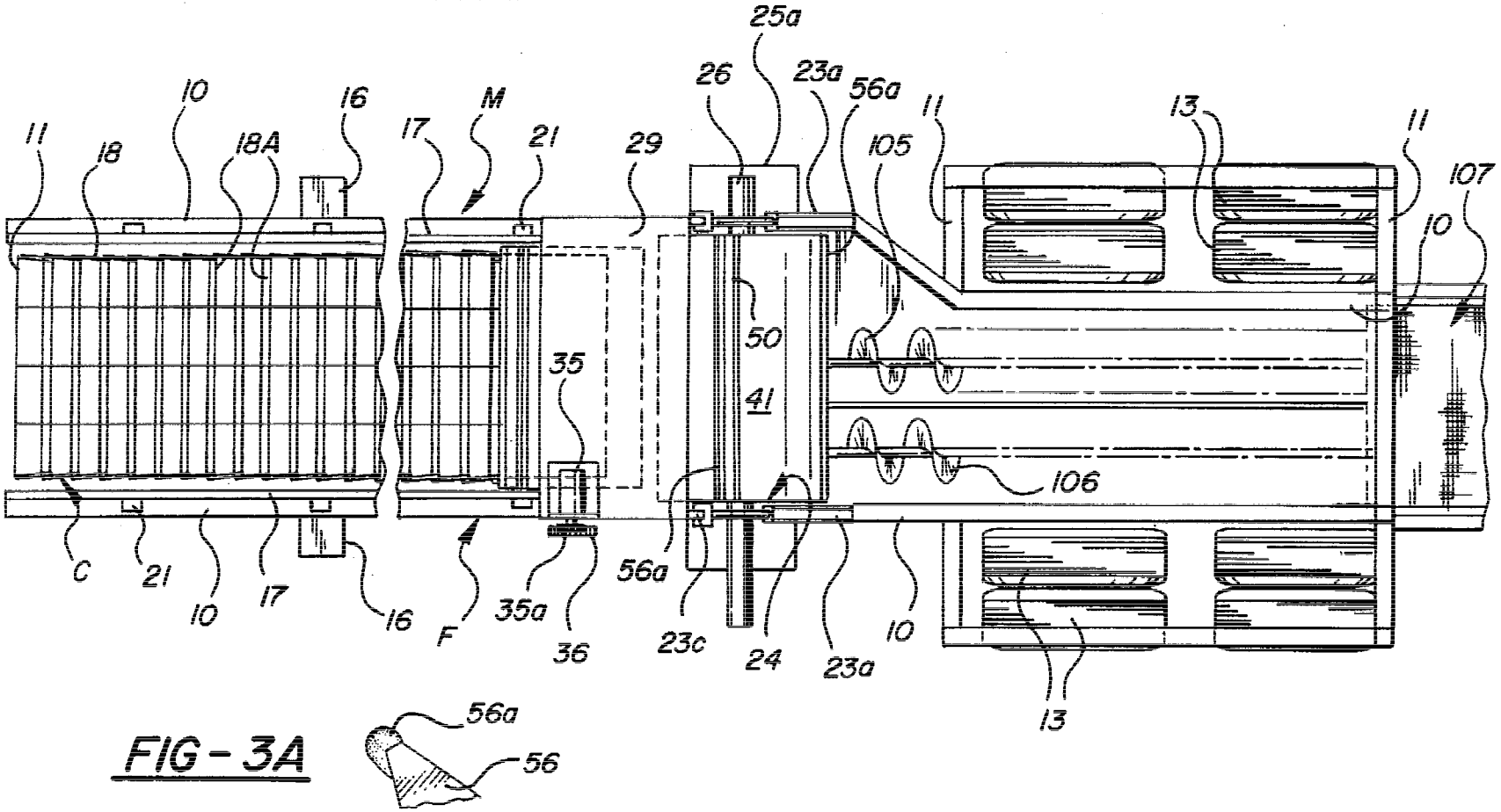
FIG. 2 is a schematic top plan view thereof.
FIG. 3A is an enlarged fragmentary side elevational view of one of the comminuting tools.

Directing attention now more particularly to FIGS. 1 and 2 in the first instance, a letter M generally designates the waste wood comminuting machine which is shown as mounted on a trailer frame F which may be readily towed to the site of use, and which has a tow coupling mounted on one of its ends to facilitate coupling the machine to a towing vehicle. The machine frame F includes longitudinal channels or beams 10 and 10*a* joined by suitable cross beams or the like 11. Wheels 12, with tires 13 thereon, are journaled on a pair of axles 14 at the rear end of the machine, and vertically adjustable front columns 15, with ground engaging, pivotal plates 15*a* thereon , are moveable in front casings 16 secured to the frame F from a retracted position to an extended position in which the support columns 15 support the machine, in conjunction with the wheels 12, in generally horizontal disposition.

At the front end of the machine, front side walls 17 are provided to house a wood receiving conveyor system, generally designated C, which includes motor driven, longitudinally extending endless chains 18 traveling over a floor plate 17*a* around front and rear sprockets 19 mounted on shafts 20 journaled to the frame F. Material supporting bars or plates 18*a* connect the chains 18. The walls 17 may be braced by vertical stanchions 21. Side walls 22 and 22*a* are also provided on the frame F rearwardly of the walls 17 to extend rearwardly therefrom to collectively house a feedwheel, generally designated 23, and a closely adjacent comminuting drum, generally designated 24. The side walls 22 have generally vertically extending arcuate slots 22*b* which are open at their upper ends as shown. The conveyor 18 and the wheel 23, operating in conjunction, or either of them singularly, may be aptly termed a feedworks for feeding material to be comminuted to the comminuting drum 24 in a continuous stream or flow.

Figure 4:
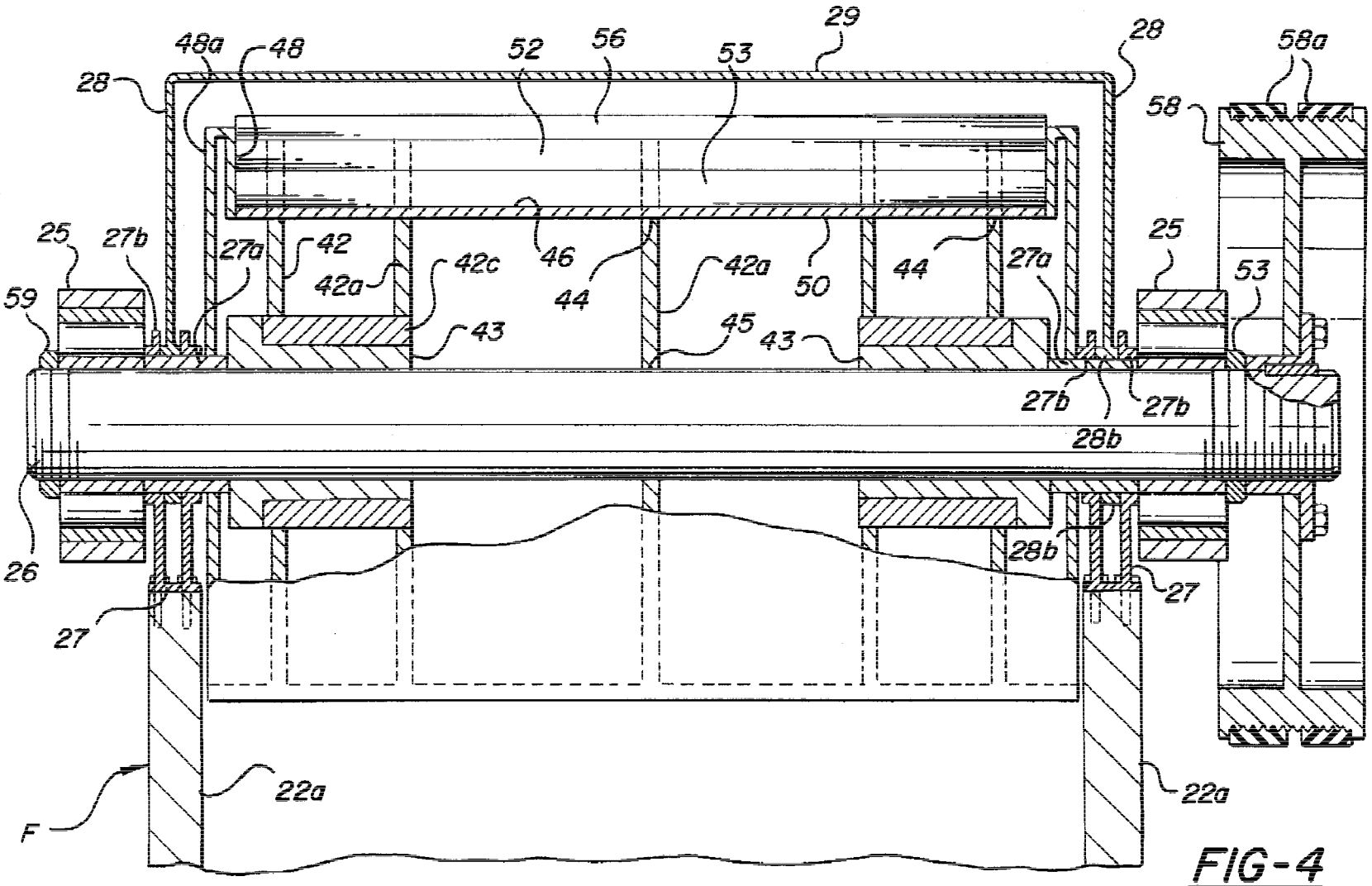
FIG. 4 is a schematic fragmentary sectional side elevational view of the drum.

Supported by the side walls 22*a* of the frame F on platforms 25*a* are journals or bearings 25 which journal the drum shaft 26. As shown in FIG. 4, provided between the ends of drum 24 and the bearings 25 are yoke mounts 27 which, like the bearings 25, are supported by the frame F and bolt to platforms 25*a*. The yoke mounts 27 include high molecular weight plastic liners or sleeves 27*a* through which the shaft 26 freely extends. The internal diameter of liners 27*a* is large enough to provide a clearance between the liners 27*a* and shaft 26 so that no load is imposable on the shaft 26. Yoke arms 28 are carried by the yoke mounts 27 to pivot about the same axis as shaft 26 and, as will be seen, the arms 28 are connected by a bridging housing 29 so that they will rigidly carry the feedwheel 23. The arms 28 have mating clamp portions 28*b* which are received between mount flanges 27*b* and bolt together around sleeves 27*a* as at 28*c*.

Figure 3:
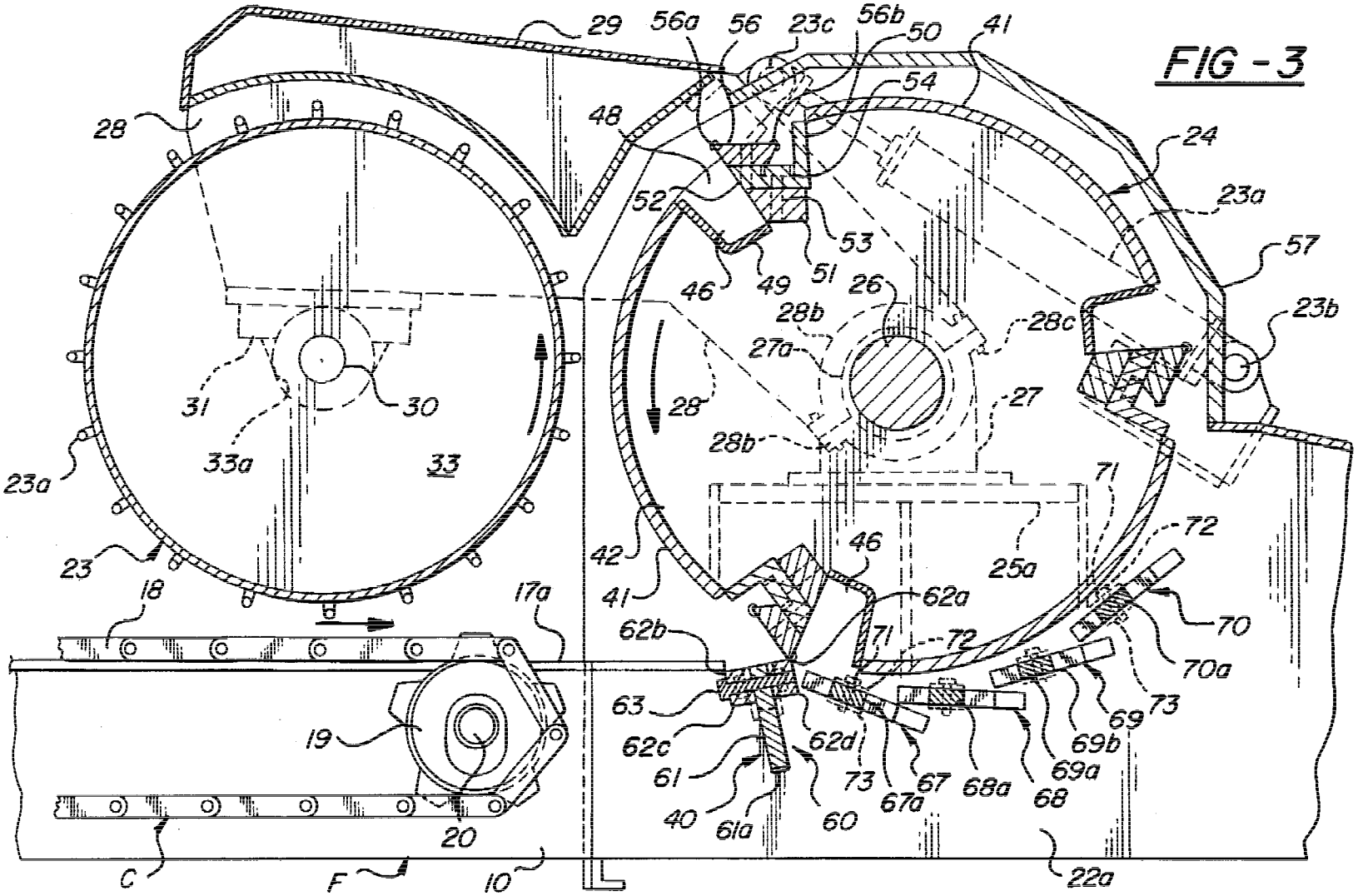
FIG. 3 is an enlarged schematic fragmentary sectional end elevational view of the feed works and comminuting drum utilized in the machine.

Before further describing the drum 24, feedwheel 23 will be described. It will be observed that the feedwheel includes a drive shaft 30 journaled by bearing mounts 31 which are carried by the yoke arms 28. Feed wheel 23 is a cylinder having circumferentially spaced radially projecting feed vanes 23*a*. The feed wheel 23 has end walls 33 with hubs 33*a* which receive hub mounts which affix the feed wheel to the shaft 30. Also fixed on the shaft 30 by a hub mount, is a sprocket 36 which, when driven by a suitable chain drive from reversible hydraulic motor 35 and motor sprocket 35*a* (FIG. 2), revolves the feed wheel 23 in the direction indicated in FIG. 1 to cooperate with the conveyor 18 and move material toward the drum 24. A chain connecting sprockets 35*a* and 36 is enclosed by a guard 36*a*. As FIG. 1 indicates, the side walls 22 are provided with the arcuate slots 22*b* to accommodate the ends of shaft 30 and permit the yoke arms 28 to be swung vertically from the raised, inoperative position indicated in FIG. 1 to an operative position in proximity to the feed conveyor C which is illustrated in FIG. 3. Fluid operated cylinders 23*a* connect to the frame at 23*b* and to the arms at 23*c* to move the feedwheel 23 to the desired position. Because the yoke arms 28 pivot about the true axis of the shaft 26, the arc of swing of the feedwheel 23 follows the path of rotation of the drum 24 and no space is created between feed wheel 23 and drum 24 which can be jammed by material which might otherwise tend to be forced upwardly by the feedwheel 23 into a position to become trapped.

It is to be understood that the yoke arms 28 pivot inwardly of the side walls 22*a* which extend rearwardly to a platform 38 (FIG. 1) supported on the rear end of rails 10 by platform legs 39. A diesel engine, generally designated DE, capable of typically delivering 800 horsepower, is supported on platform 38 to power the feedwheel 23 and the comminuting drum 24 in a manner which presently will be more particularly described. An anvil system, generally designated 40, operates in conjunction with the comminuting drum 24 and presently will also be described in more detail.

As FIGS. 3 and 4 particularly indicate, the comminuting drum 24 comprises a series of arcuate peripherally spaced plates 41 which are joined by inset end plates 42 and a series of internal support disc plates 42*a* to form a circumferentially interrupted cylinder. Alternatively, plates 41 could be in the configuration of shallowly angular plates. Openings 42*b* are provided in the end walls 42 and endmost plates 42*a* to receive sleeves 42*c* and hubs 43 which key to the drum shaft 26. The end walls 42 are also peripherally recessed as at 44, as are each of the spacer discs 42*a* which are spaced laterally over the length of drum 24. The spacers 42*a* are, like the end walls 42, fixed as, for instance, by welding, to the plates 41 and the middle plate 42*a* is also internally bored as at 45 to pass and fix to the shaft 26. The tool mounting cavities 46 formed between plates 41 are open the axial length of the drum 24, and are closed by end caps 48 provided on end housings 48*a* which enclose but impose no load on sleeves 27*a*. Transversely extending lead angle members 49 are welded to the peripherally trailing edges of plates 41 and to the plates 42 and 42*a*, and further to trailing transversely extending mount bars 51. Bottom mount bars 51, also welded in position to plates 42 and 42*a* in the same manner, receive the tool holder portions 52 of angle plates 50 which are welded to the leading edges of plates 41 and releasably bolt to the members 51 as at 53 over the axial length of the drum 24. Because members 51 and 52 are tilted back relative to the path of rotation, tool forces tend to be resisted by the tensile strength of bolts 53 rather than tending to bend these bolts. The holder parts 52 have recessed circular openings 54 for receiving the heads of the bolts 53. Bolted as at 55 to the holder parts 52 are high strength steel comminuter tools or tool members 56 which have opposite comminuting material bead edges 56*a* and 56*b* which extend the full length of tools 56 between the end caps 48 FIG. 3A more particularly indicates the curvilinear bead edges 56*a* and 56*b* which are formed as in the aforementioned co-pending patent application of a weld rod material matrix incorporating tungsten carbide grit. Plainly, when bolts 55 are backed off, the comminuting members 56 may be turned 180 degrees to substitute the edges 56*b* for the edges 56*a*, or to replace the comminuting tool members 56, or any one of them, when this becomes necessary. Provided ahead of each comminuting tool member 56 is a cavity within angle 49 in which wood chipped by the member 56 can collect prior to its being expelled by centrifugal force. A top wall 57 connects to the side walls 22*a* to prevent material from being thrown out of the machine. Provided to drive shaft 26 is a drive sheave 58 driven by belts 58*a* powered by the diesel engine DE. The sheave 58 is keyed to the shaft 26 which has threaded ends for receiving threaded end rings 59. As the heavy drum, which typically may be six feet in length, rotates at speeds in the neighborhood of 2100 r.p.m., comminuting tool members 56 are successively presented to the material feed stream.

Figure 6:
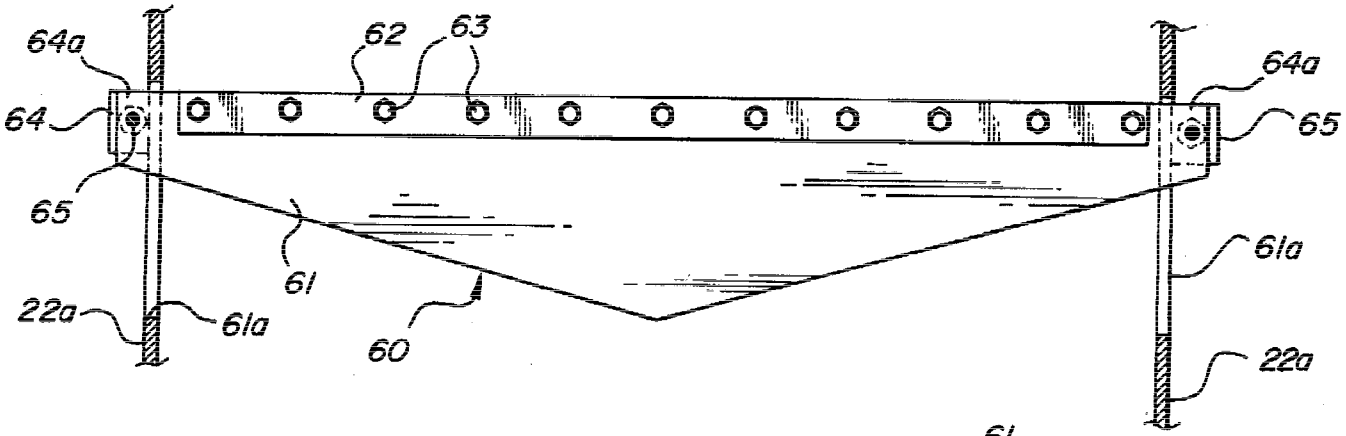
FIG. 6 is an enlarged fragmentary schematic side elevational view, more particularly illustrating the lead anvil assembly.

As shown, particularly in FIGS. 3 and 6, the anvil system 40 includes an initial or lead anvil bar assembly 60. The lead anvil bar assembly includes an anvil supporting midplate 61, which extends out elongated vertical slots 61*a* provided in the sidewalls 22*a*. A pair of high strength steel anvil bars 62 bolt to each side of the plate 61 as at 63 and each provides four interchangeable anvil edges. The exposed edges are shown at 62*a*, 62*b*, 62*c* and 62*d* in FIG. 3. U-shaped guides or holders 64 fixed to the exterior of walls 22*a* accommodate the ends of the plates 61 and shear bolts 65 extend between the side walls 64*a* of the holders 64 to normally secure the lead anvil assembly 60 in position. As FIG. 3 indicates, the slots 61*a* extend at a vertical angle which is inclined from top to bottom in a rearward direction and are wide enough to permit transverse withdrawal of the plate 61 and carrying bars 62 as an assembly.

Figure 5:
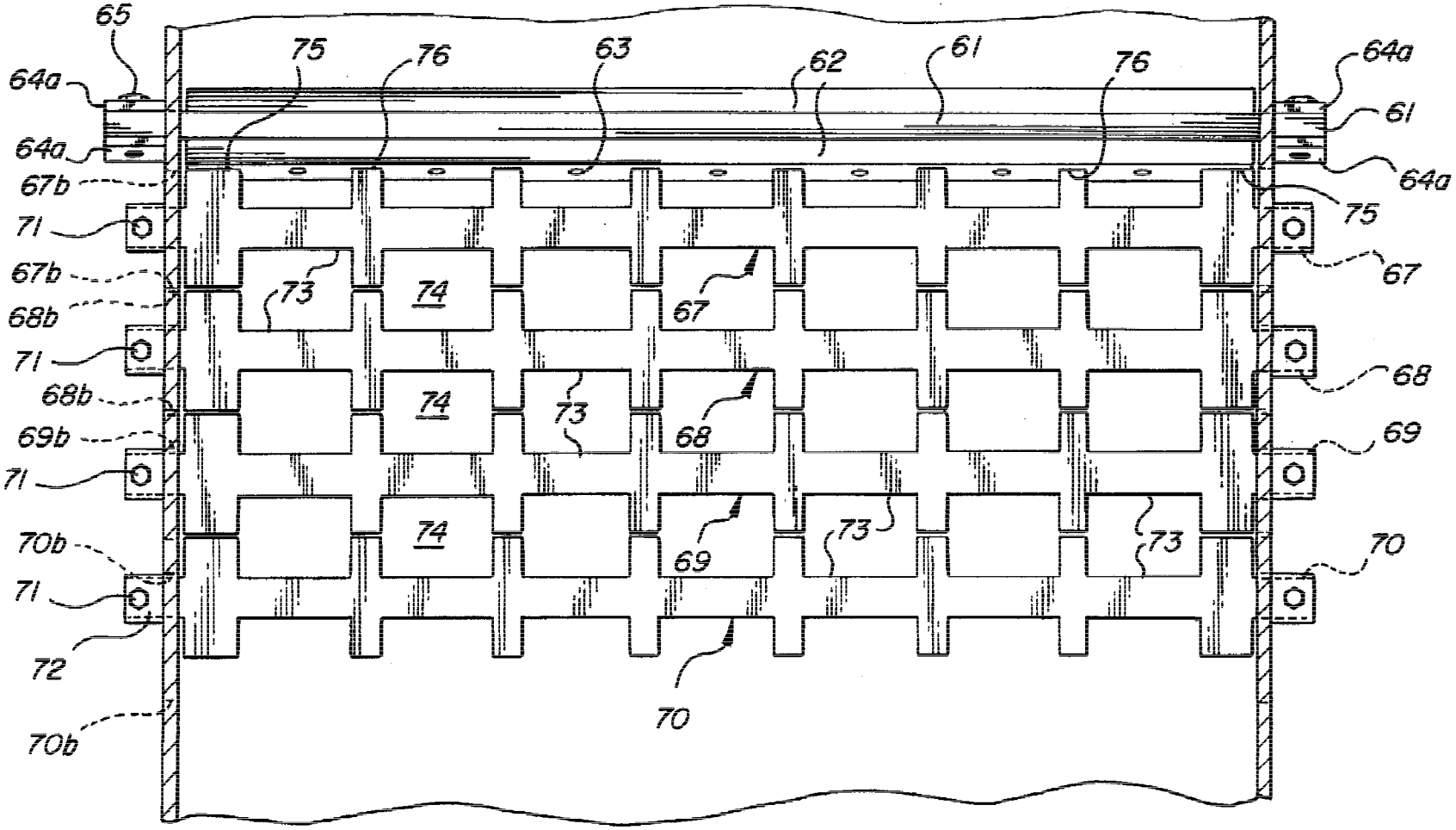
FIG. 5 is an enlarged, fragmentary schematic top plan view, more particularly illustrating the anvil system which is employed.

Directing attention now particularly to FIG. 5, it will be seen that rearwardly of the lead anvil assembly 60 are a series of four individual anvils 67, 68, 69, and 70 which, as FIG. 3 shows, are arranged on a path which circumferentially follows the path of rotation of the drum plates 41. Each of these anvils 67–70 has terminal ends 67*a*, 68*a*, 69*a*, and 70*a*, respectively, which extend through elongate slots 67*b*, 68*b*, 69*b*, and 70*b*, respectively, provided in the walls 22*a*. As FIG. 3 particularly indicates, the respective members 67–70 are so individually positioned to extend generally tangentially to the path of drum rotation that they do not interfere with retracting movement of the other anvil members in a rearward direction. The members 67–70, however, are normally prevented from retracting movement by shear bolts 71 which extend through the members 67–70 to secure them to pairs of upper and lower plates 72 and 73 fixed to the side walls 22*a* of the frame F. As will be explained in more detail subsequently, when undue force is exerted on the bolts 63, or on the bolts 71, the anvils 61, 67, 68, 69, and 70 are free to retract out of harms way.

As FIG. 5 particularly indicates, the anvils 67–70 are recessed along their lengths as at 73 to provide openings 74 between them. This recessing provides a series of end anvil edges 75 and intermediate anvil edges 76.

Figure 8:
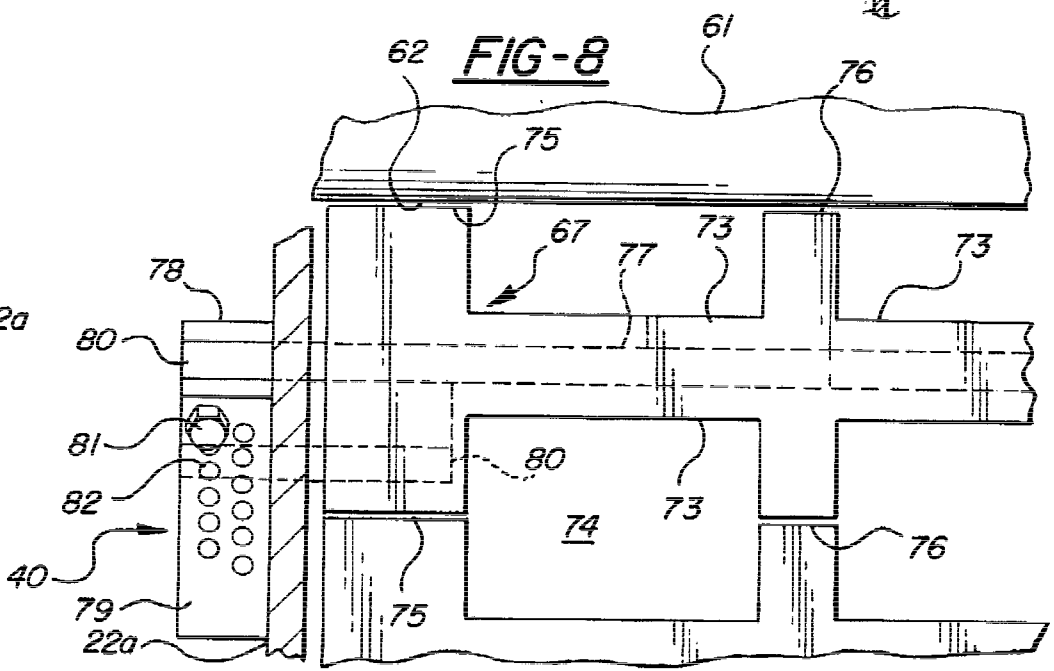
FIG. 8 is a fragmentary top plan view illustrating the modified mounting system.
Figure 7:
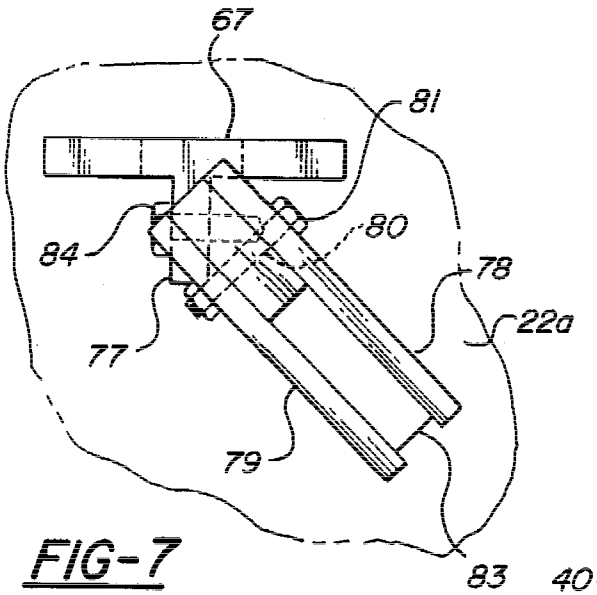
FIG. 7 is an enlarged fragmentary schematic end elevational view illustrating another manner of releasably mounting the individual breakaway downstream anvils.
Figure 9:
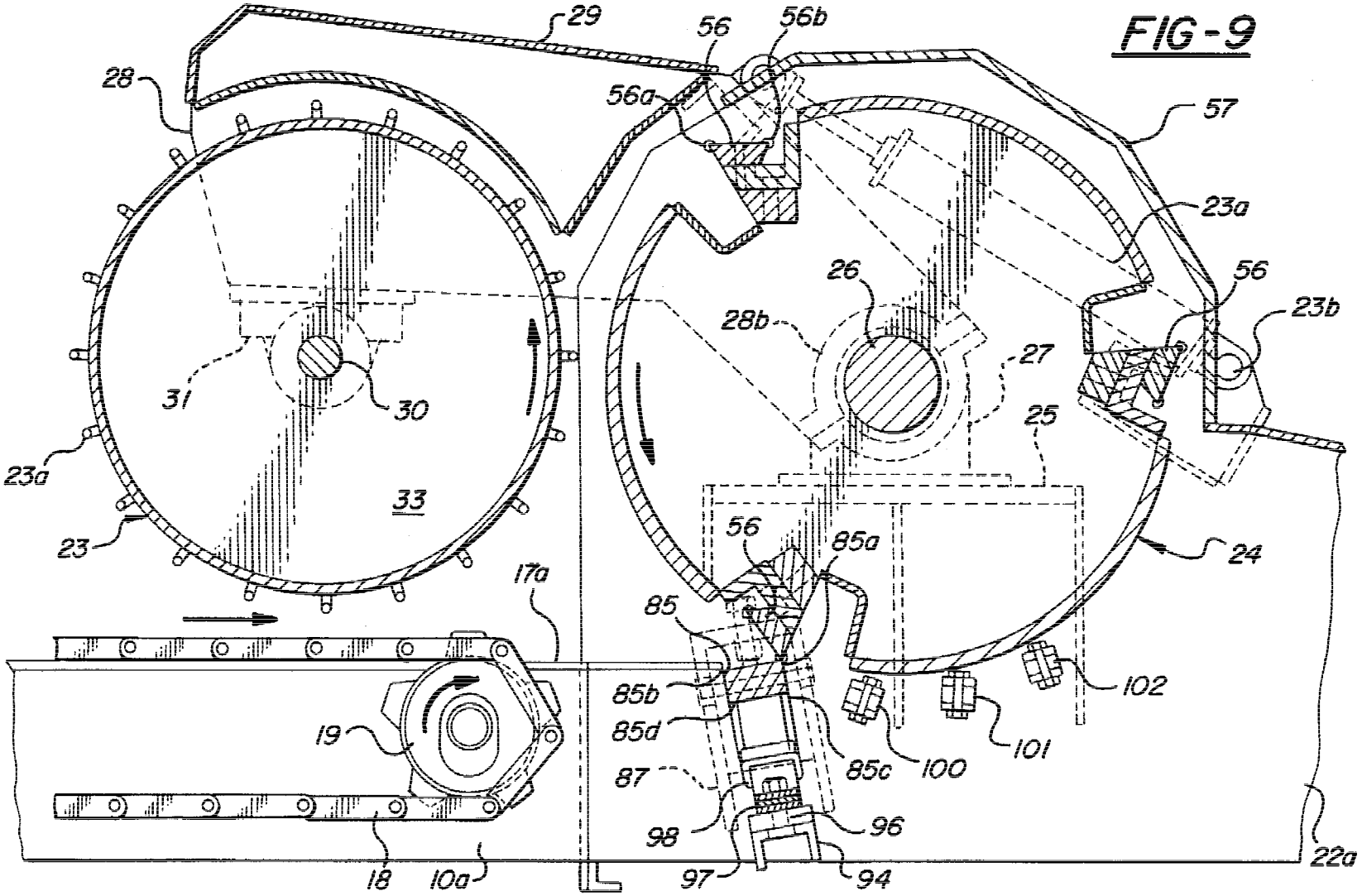
FIG. 9 is a view similar to FIG. 3 schematically illustrating another embodiment of the invention which employs a lead anvil restoring spring.

FIGS. 7 and 8 illustrate a modified manner of mounting the bars 67–70. In this configuration, each of the bars 67–70 is T-shaped in the sense it is provided with a dependent leg 77. In FIG. 7 only the anvil member 67 is shown, but it is to be understood that the other anvil members 68–70 are mounted in exactly the same way. In this configuration, the bars 78 and 79, which weld to the side walls 22*a*, receive an anvil slide or shoe 80 to which they are bolted by shear bolts 81. It will be observed that a series of openings 82 are provided in the plates 78 and 79 to permit the bolts 81 to be positioned in any one of them, or to provide for the use of more than one shear bolt 81 if desired. It is the shoes or slides 80 which extend out the elongate slots 83 provided in the side walls 22*a*, the dependent legs 77 being fixed to the slides 80 by way of bolts 84.

An alternative embodiment of the anvil system 40 will now be described. As shown particularly in FIGS. 10–12, the anvil system 40 is comprised of an initial or lead anvil bar 85 which has four interchangeable anvil edges 85*a*–*d*. The anvil bar 85 spans the side walls 22*a* and extends out the vertically elongated slide slots 86 provided therein. Fixed on the exteriors of the side walls 22*a* are vertical guides 87 which parallel the slots 86. The guides 87 receive U-shaped anvil holders or slides 88 to which the anvil 85 is secured at each end as with a nut and bolt assembly 89. Above each set of guides 87, a plate 90 is secured to the side walls 22*a* at each end of the anvil 85 and an adjusting bolt 91 is suitably received in a threaded opening 92 to extend down to bear against the end of the anvil 85. The position of each bolt 91 is secured by a nut 93. Plainly, by backing off the anvil adjuster bolts 91 and removing the bolt and nut assemblies 89, the anvil 85 can be repositioned to position any of the edges 85*a*–*d* in operative position. Preferably, the operative edge will have an operating clearance of about 30 thousandths with respect to the path of rotation of the bead edges of the comminuting members 56.

It will be seen that a channel member 94 is provided at a spaced distance below the anvil 85 and supports a laterally centrally disposed preloading block 95 which can be adjusted upwardly and downwardly relative to channel 94 on a bolt and nut assembly 96 threaded into a threaded opening in channel 94. A leaf spring, generally designated 97, has its central portion bearing on the block 95 and is comprised of three leaves, as shown, captured at their ends by the usual shackles 98. The innermost leaf 95 of spring 95 has its ends turned outwardly and downwardly as at 99 to bear on the anvil 85. It is to be understood that, dependent on the material being comminuted, the spring 85 will consist of greater or fewer leaves and that the block 95 is initially adjusted to impose the desired pressure resisting preload on the spring 72. Typically spring 97 may be a thousand pound spring. Bolts 91 act in opposition to the spring 72 to position the anvil 85.

Just downstream from the anvil 85 are fixed anvil bars 100, 101, and 102 which each have four interchangeable anvil edges. The anvils 100–102 span the side walls 22*a* of the frame F and extend out openings 103 provided therein. Generally vertically spaced apart plates 104 and 105 welded to the side walls 22*a* have threaded openings for receiving bolts 104 that extend down through openings in the anvils 100–102 to be secured by nuts. Thus, anvils 100–102, which are arranged on the arc of rotation of the drum comminuting members 56 such as to leave an operating clearance of about thirty thousandths between them and the comminuter tools 56, are provided to more finely comminute the wood fragments or chips which progressively proceed to them.

With either anvil system, the comminuted material drops downwardly between the sidewalls 22a of the frame to a pair of conveying augers 105 and 106 which extend as shown in FIG. 2 from beneath the anvil system 40 to feed the material received to an outgo conveyor system, generally designated 107. The twin augers 105 and 106 are rotated in directions to feed the material rearwardly to conveyor 107 which, preferably, will have a magnetic removal device and an "overs" screen for separating tramp iron pieces and the like which are interspersed with the comminuted wood material. The material separated may, of course, include comminuted magnetizable material which the machine will comminute, such as nails, spikes, and half-inch bolts, for instance.

Figure 10:
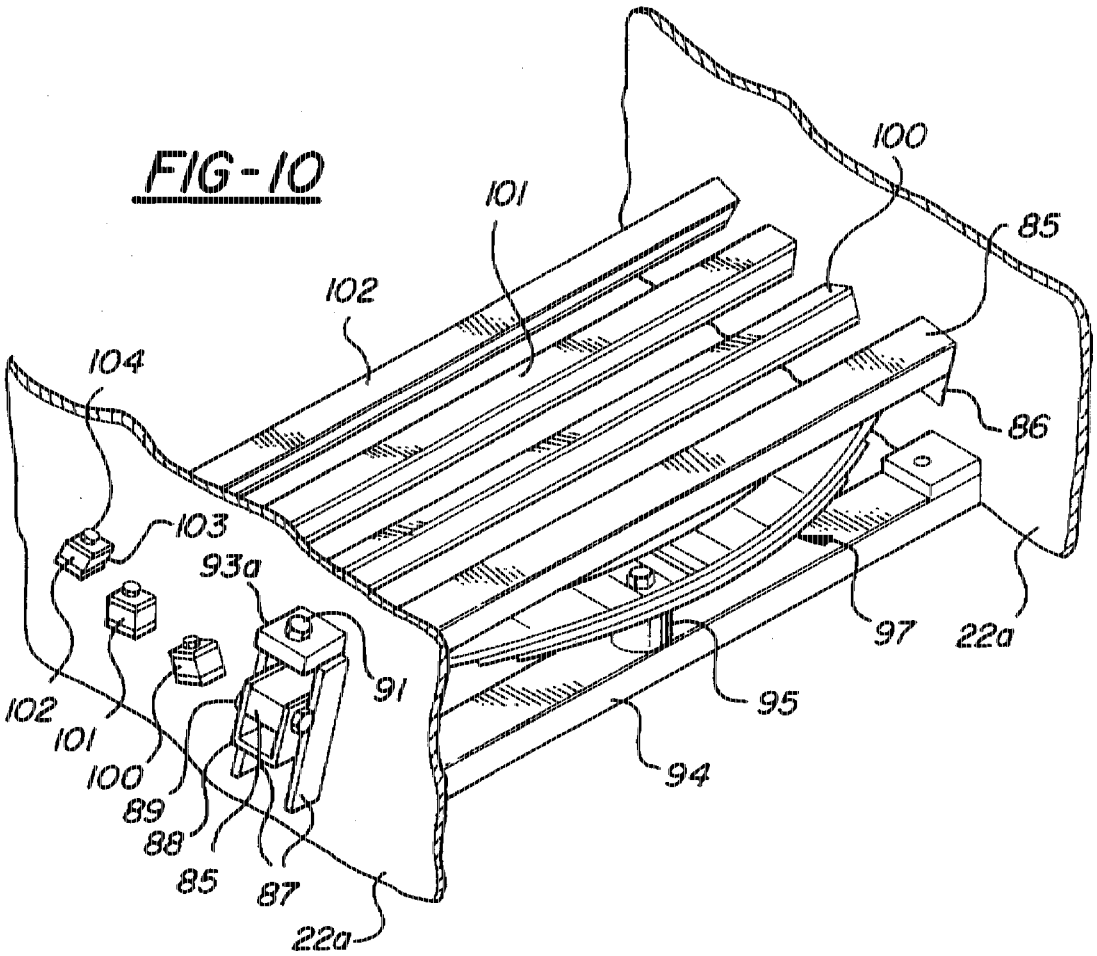
FIG. 10 is a fragmentary schematic perspective plan view of the anvil system of the modified embodiment.
Figure 11:
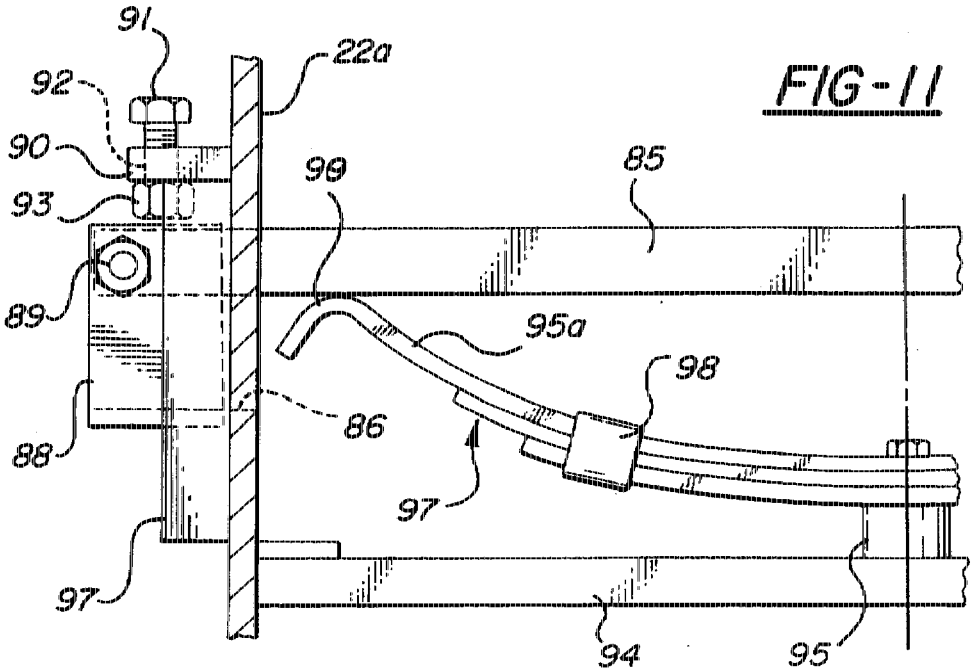
FIG. 11 is an enlarged fragmentary schematic side elevational view of the lead anvil mount system thereof.
Figure 12:
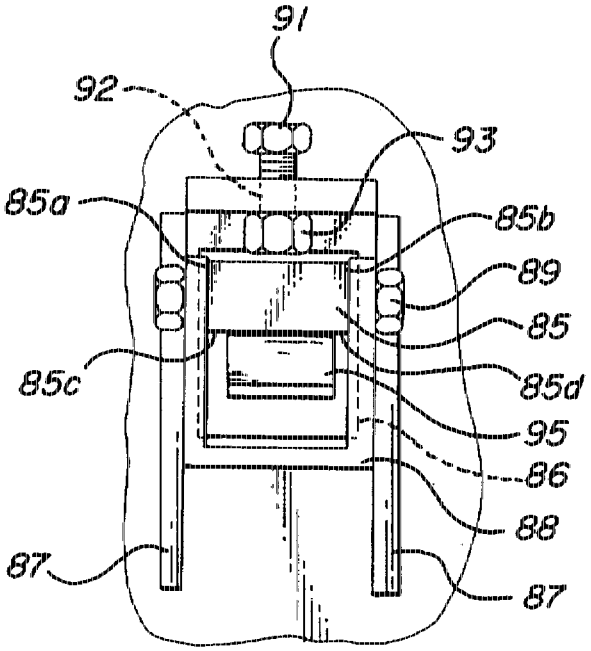
FIG. 12 is a fragmentary schematic end elevational view thereof.
Figure 13:
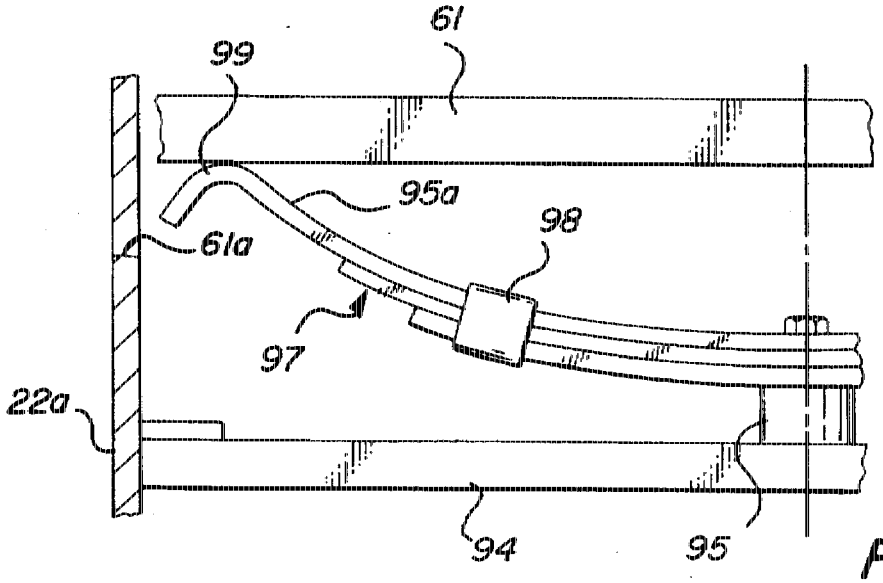
FIG. 13 is a fragmentary schematic view similar to FIG. 11 illustrating still another embodiment of the invention.

It is to be understood that the spring 97 disclosed in FIGS. 10–12 may be used in conjunction with the lead anvil assembly disclosed more particularly in FIG. 3. This further embodiment is illustrated in FIG. 13. In this modification, the lower surface of member 61 is made horizontal in the manner of the anvil member 85 in FIG. 11, and the spring 97 bears against it in the manner disclosed in FIG. 11. The preload member 95 is in the position shown in FIG. 11. When the shear bolts 65 shear, due to an undue force, which moves the anvil 60 downwardly, the spring 97 later restores the anvil 60 to operative position once again.

It is the diesel engine DE which powers the various operating elements including wheel 23, drum 24, augers 105 and 106, conveyor 107 and the cylinders 23a. A hydraulic system including a pump driven by the engine DE, a reservoir, suitable control valves, and appropriate lines is used to supply hydraulic fluid to the hydraulic motors.

THE OPERATION

Considering first of all FIGS. 1–6 of the disclosure, it is to be understood that wood structures of a heavy nature would be supplied by crane or other loader to the conveyor bed C within side walls 17, and be fed by the feedworks to comminuting drum 24. The cylinders 23a would be operated to lower the feed wheel 23 to a desired position relative to the conveyor chains 18. Because the arms 28, which mount the feedwheel shaft 30, pivot about the true axis of the drum shaft 26, material does not get carried up to jam between the feedwheel 23 and drum 24. As FIG. 4 indicates, the arms 28 are mounted for pivotal movement on a sleeve 27a which is concentric with the axis of drum shaft 26 but is out of contact with it, in the sense that there is an operating clearance between the sleeves 27a and the shaft 26.

With the feedworks feeding material in a constant flow path along the floor plate 17a, which extends beyond the conveyor C to substantially the anvil system 40, material is comminuted by the comminuting tools 56, as the drum 24 rotates counterclockwisely in FIG. 3 past the anvil system, into chips and fragments which then pass downwardly through the openings 74 to the augers 105 and 106. The material is impacted and fragmented, first of all upstream of the anvil system, by the beads 56a on tools 56 with a material shattering impact. It is more finely reduced then, when the tool bead edges pass the lead anvil edge 62a provided on anvil bar 62. It then is progressively reduced in size by passing between the tool edges 56a and the anvils 67a, 68a, 69a, and 70a. With wear, plainly the tools 56 can be turned end for end to present fresh bead edges 56b, and the anvil bars 62 each can present four operative edges when bolts 63 are backed off and their position is adjusted relative to the anvil plate 61. The lead anvil assembly 61, 62 is readily removable out one of the slots 61a provided in side walls 22a for interchanging or replacement purposes.

Likewise, each of the anvils 67a through 70a are adjustable when the bolts 71 are backed off to present any one of four different edges 75 and 76 to the tools 56. Again, the anvils 67a–70a are readily removable out slots 67b–70b so this can be done from outside the machine.

It is when the material being fed to the drum 24 includes sizeable tramp metal pieces, or pipe lengths and other foreign objects that the anvil system 40 is operative to protect the machine. When one of these foreign objects is encountered by one of the tools 56 and cannot be comminuted, the bolts 63 shear with the result that anvil plate 61 and the anvil bars 62, which it carries, are moved downwardly to relieve the pressure which otherwise might destroy the shaft bearings or bend the shaft 26. The lowering of the anvil plate 61 further, of course, prevents destruction of the anvil assembly itself and provides a space for the foreign object to drop through the machine to the augers 105 and 106.

Similarly, each of the individual successive anvils 67a, 68a, 69a, and 70a are free to be forced in a rearward direction, when shear bolts 71 shear, to move them out of harm's way. A non-comminutable body which causes the bolts 71 to shear will be hurled downwardly by centrifugal force. Tramp pieces which have trouble ejecting can be carried in the pockets 46 until they are hurled through the openings 74 between the individually retractable grates 67–70. When lengthier pieces of tramp metal such as pipe pieces are encountered, they can be carried in the pockets 46 beyond the anvil system to be also ejected by centrifugal force.

In normal operation, the anvils 67–70 encounter longer shreds or fragments of material and tend to progressively reduce them to finer fragments. Thus, when material proceeding from the augers 105 and 106 to conveyor 107 is received on the conveyor 107, the material can be screened to collect the wood chips or fragments which fall through the screen. The tramp metal in the mix can be removed by magnetizable elements, or as "overs" which do not fall through the screen.

In FIGS. 1–6, it is the anvil support plate 61 which is guided in the slot 61a in its retracting movement when bolts 65 shear. Likewise, the anvils 67–70 are guided in retracting movement by the slots provided in the sidewalls 22a to accommodate these anvils.

In FIGS. 7 and 8 a slightly different arrangement is indicated wherein the anvil members are wholly within the side walls 22a of the frame F and shoes 80, affixed to the anvil members, slide between guides 78 and 79 provided on the exterior faces of walls 22a when bolts 81 shear.

In the operation of the embodiment disclosed in FIGS. 10–12, the spring 97 exerts the restraining pressure on the anvil 85 but permits downward travel of the anvil 85 when undue pressure is encountered, with shoes 88 guiding in plates 87 on the exterior faces of sidewalls 22a. The preloading blocks 95 are initially adjusted to impose the desired preload on springs 97 which may, for example, be preloaded to give only when a pressure of, for example, three thousand pounds is imposed by tramp metal or the like coming between one of the tools 56 and the anvil 85. In this embodiment of the invention, the anvil 85 is thus, in effect, "set" to depress in slots 86 provided in the sidewalls 22a under a predetermined pressure to move out of harm's way and permit the tramp metal or the like to be expelled by centrifugal force to the augers 105 and 106 below. When this occurs, the spring 97 will restore the anvil 85 to operating position. Because a leaf spring device 97 is employed which can be preloaded for the particular material being processed, i.e., such as heavy wood pallets, operation of the machine can recommence with restoration of the position of the anvil 85 by the spring 97. Also with the bolts 89 on the exterior sides of the machine, it is a simple matter to remove bolt and nut assemblies 89 to permit the anvil bar 85 to be rotated to present fresh edges to the tools or to be removed and replaced entirely. The same thing is true of the fixed anvil members 100, 101 and 102 when the bolts 104 are removed. As indicated earlier, the tools 56 are readily replaceable and can be designed to fit the work which is to be comminuted.

Finally, as indicated earlier, it is possible to use one of the springs 97 in conjunction with the system disclosed in FIGS. 1–6 of the invention. The spring 97 would restore the lead anvil assembly 61, 62 to position to operate once again, until there was an opportunity to replace the severed shear bolts 63.

The disclosed embodiment is representative of a presently preferred form of the invention, but is intended to be illustrative rather than definitive thereof. The invention is defined in the claims.

I claim:

1. In a horizontal comminuting machine for reducing recyclable waste wood and other comminutable material which may have non-reducible foreign objects incorporated with it:

a) a longitudinally extending frame having spaced apart side walls;

b) a generally horizontal rotary member journaled on said frame between said side walls and having a plurality of peripherally spaced comminuting members traveling in a continuous work contacting path;

c) a drive connected with said rotary member for moving said comminuting members in said path;

d) a feed works connected with said frame for delivering said material forwardly to said rotary member in a longitudinal material feed stream;

e) an endwisely withdrawable anvil device with anvil edges, spanning said side walls and having ends extending outwardly beyond said side walls, movably mounted on said frame for sliding travel from an operative position adjacent said rotary path of the reducing members to a retracted position more remote from said path;

f) an anvil path confining assembly permitting back and forth travel of said anvil device incorporating guides confining said travel to bodily sliding travel with a predominant vertical component adjacent openings in said side walls of the frame out which said ends of the anvil device protrude;

g) anvil restraint shear parts supported on said frame and interconnecting said protruding ends and frame to normally maintain said anvil device in said operative position, and shearable under a comminuting pressure greater than that imposed by material that can be comminuted in the machine to permit the foreign objects to be thrown out by centrifugal force when the anvil device retracts; and h) Said anvil device being free of said frame for endwise withdrawal purposes except for said shear parts, and at least one of said openings being of a size and shape to permit endwise withdrawal of said anvil device when it is freed by shearing of said shear parts.

2. The machine of claim 1 wherein said rotary member comprises a drum rotatable on a drum shaft about a horizontal axis extending crosswisely to said feed stream of the material to be comminuted, and said anvil device extends parallel to said axis.

3. The machine of claim 2 wherein said drum has axially parallel pockets in its periphery extending substantially from end to end of said drum; mount blocks are fixed in said pockets to leave material carrying open portions in advance thereof in the direction of rotation of said drum, and said comminuting members are releasably supported on said mount blocks; said comminuting members having work contacting radially outer edges, faced with carbide grit curvilinear beads, extending from end to end of said pockets.

4. The machine of claim 3 wherein said comminuting members have opposed outer bead edges and are rotatable 180 degrees to expose fresh such edges to the material.

5. The machine of claim 4 wherein said bead edges are curvilinear and comprised of a weld material matrix with particulate carbide grit randomly dispersed therein.

6. The machine of claim 4 in which said drum has internal longitudinally spaced support rings with an associated shaft journalling said rings and drum, and said feed works has a feed wheel mounted for vertical swinging movement on a yoke having arms pivotally journaled on yoke supports through which the drum shaft freely extends, there being a drive driving said feed wheel in a direction of rotation to advance material to said drum, and there being a fluid operated cylinder connected to said frame and yoke to swing said feed wheel.

7. The machine of claim 2 wherein said feed works includes a longitudinally extending material support member and a revolvable feed wheel mounted on said frame above said material support member adjacent said drum for vertical movement toward and away from said material support member; there being a drive connected with said feed wheel for normally revolving said feed wheel in a direction to move material to be comminuted toward said drum.

8. The machine of claim 7 wherein said feed wheel is mounted on a yoke carried by said frame which is swingable about the axis of said drum, and said material support member comprises the upper run of a longitudinally extending endless conveyor.

9. The machine of claim 2 wherein rearwardly of said anvil device a plurality of longitudinally spaced anvil-like members aligned with the path of rotation of the drum extend crosswisely parallel to said withdrawable anvil device adjacent to said feed path of the comminuting members.

10. The machine of claim 1 in which said anvil restraint parts are shear bolts fixed to said protruding anvil device ends and side walls.

11. A horizontal comminuting machine comprising a frame having front and rear ends and spaced apart side walls having a generally horizontal axis mounted on said frame on a laterally extending shaft projecting beyond the ends of said drum; bearings journalling said shaft on said frame, comminuting members projecting from the drum; a drive connected to power said drum and move said comminuting members in a path of rotation; a crosswisely extending anvil mounted on said frame adjacent the path of rotation of said comminuting members to coact therewith in reducing said material; a feed works connected with said frame, including a feed surface on which said material is supported and a power driven feed wheel having a generally horizontal axis generally parallel to said drum axis mounted above said feed surface to move said material to said drum; a front to rear extending swingable yoke connected to said feed wheel for swinging said feed wheel in a vertical path toward and away from said feed surface; said yoke having rearwardly extending arms with releasable clamps thereon and a power operated drive for swinging said yoke about the axis of said drum, the improvement wherein:

a) yoke mounts are fixed on said frame to pass the drum shaft adjacent of said shaft bearings, each of said yoke mounts having a sleeve around which one of said yoke arms is clamped and pivotally received, there being a peripheral clearance maintained between said sleeves and shaft to avoid imposing load on said shaft.

12. In a horizontal comminuting machine for reducing recyclable waste wood and other comminutable material or wood which may have non-reducible tramp objects incorporated with it;

a) a frame having spaced apart side walls;

b) a generally laterally extending horizontal rotary drum journaled on said frame between said side walls and having a plurality of peripherally spaced comminuting members traveling in a continuous work contacting path;

c) a drive connected with said rotary drum for moving said comminuting members in said path;

d) a feed works connected with said frame for delivering said material forwardly to said rotary drum in a longitudinal material feed stream;

e) an endwisely removable lead anvil with multiple anvil edges spanning said side walls and having end parts, protruding through said side walls;

f) retention parts consisting essentially of yieldable shear parts normally interconnecting the anvil end parts and side walls to maintain the anvil in an operative position adjacent the path of the comminuting members and yielding when undue pressure is exerted on the anvil to permit the anvil to move from an operative position adjacent said rotary path of the comminuting members to a removed position more remote from said path;

g) an array of additional and individual separately endwisely withdrawable anvils positioned on said frame downstream from said lead anvil and extending generally in planes generally tangential to said path; said additional anvils being configured with laterally spaced apart fore and aft projections, with the projections on said adjacent additional anvils being in confronting alignment to compositely form a grate with openings therein, said additional anvils spanning said frame and said projections having lateral anvil edges, and there being elongate openings of a size and shape in said side walls to permit endwise individual removal of said lead anvil and said additional anvils from said side walls, as well as tangential rearward sliding retraction movement of said additional anvils, said additional anvils having end parts projecting through said openings and being only retained normally in operative position by external shear fasteners interconnecting said side walls and said projecting end parts.

13. The apparatus of claim 12 in which said aft edges of said projections on the additional anvils have anvil edges.

14. In a comminuting machine for reducing waste wood and other comminutable material which may have non-reducible tramp objects incorporated with it:

a) a frame having spaced apart side walls;

b) a generally laterally extending rotary drum journaled on the frame between the side walls and having a plurality of peripherally spaced comminuting members traveling in a continuous work contacting path;

c) a drive connecting with said rotary drum for moving said comminuting members in said path;

d) a feed works connected with said frame for delivering said material forwardly to said rotary drum in a fore to aft moving longitudinal material feed stream;

e) an endwisely removable lead anvil, retractable in a slide path with a dominating vertical component and having anvil edges generally spanning said side walls, said lead anvil having endmost parts protruding through said side walls;

f) retention parts consisting essentially of yieldable shear parts normally interconnecting said lead anvil endmost parts and side walls to maintain the lead anvil in operative position adjacent the path of the comminuting members and yielding when undue pressure is exerted on the lead anvil and the shear parts are sheared to permit the lead anvil to move from an operative position adjacent said path of the comminuting members to a retracted position more remote from said path;

g) an array of additional individual, endwisely separately withdrawable anvils positioned on said frame rearwardly of said lead anvil and extending conjunctively in a general tangential path relative to said drum; and h) said side walls having aligned openings which are of a size and shape in at least one side wall to permit separate endwise removal of said lead anvil and additional anvils through at least one of said side walls, said additional anvils having end parts projecting through said aligned openings, and fastener parts interconnecting said additional anvil end parts with said frame, said additional anvils being only retained in operative position by said fastener parts.

15. The apparatus defined in claim 14 in which a fore to rear array of guides extending at a less vertically acute angle than said lead anvil slide path is provided exteriorly on at least said side one wall, blocks connected to said additional anvils are provided on said anvil end parts to slide in said guides, and said fastener parts are shear parts extending between said blocks and guides.

16. The apparatus of claim 14 in which said lead anvil incorporates a shear bar with multiple interchangeable shear bar edges.

17. The apparatus of claim 14 in which said openings for said additional anvils are elongate relative to said additional anvil end parts in a front to rear direction, said fastener parts are shear parts, and said additional anvils incorporate shear bars with multiple interchangeable shear bar edges.

* * * * *